United States Patent [19]

Miles

[11] 4,019,468

[45] Apr. 26, 1977

[54] SUPPORT FOR FURNACE TUBES

[75] Inventor: Bert Benton Miles, Tulsa, Okla.

[73] Assignee: Combustion Engineering, Inc., Windsor, Conn.

[22] Filed: Apr. 21, 1976

[21] Appl. No.: 675,356

[52] U.S. Cl. ..... 122/510; 165/162; 248/49

[51] Int. Cl.[2] ..... F22B 37/24

[58] Field of Search ..... 122/6 A, 510; 165/162; 248/49

[56] References Cited

UNITED STATES PATENTS

| | | | |
|---|---|---|---|
| 2,345,257 | 3/1944 | Hensel et al. | 122/510 |
| 2,355,800 | 4/1944 | Hensel | 122/510 |
| 2,883,973 | 4/1959 | Reagan | 122/510 |
| 3,346,043 | 10/1967 | Thurnauer | 122/510 |
| 3,720,259 | 3/1973 | Fritz et al. | 165/162 |

*Primary Examiner*—Kenneth W. Sprague
*Attorney, Agent, or Firm*—Arthur L. Wade

[57] ABSTRACT

A furnace has its interior walls covered with tubes which carry fluids being heated has supports for the tubes extended from the furnace shell. The supports are attached to the inside of the shell and extend beyond the refractory lining the shell. A strap member on each support extends from, and is movable in, tracks of each support to clamp a tube to the support.

4 Claims, 2 Drawing Figures

SUPPORT FOR FURNACE TUBES

BACKGROUND OF THE INVENTION

1. Field of the Invention

The invention relates to structural support for elongated tubes, or pipes, mounted on the refractory of furnace walls with replaceable parts. More specifically, the invention relates to a multi-part hanger which supports a furnace tube within a furnace space and which includes a part most vulnerble to service conditions but which is readily replaced.

2. Description of the Prior Art

The high temperatures and wide swings in temperature within an industrial furnace are factors in creating a severely hostile environment for any structures within the furnace. Of course the central structure is the tube, or pipe, carrying the fluid to be heated. It is common practice to support these conduits at the walls of the furnace so they will be exposed to the heat of combustion within the furnace.

It is common practice to line the internnal wall of the furnace with four to six inches of refractory and suspend the pipes at the surface of this material. Positions are selected along the interior shell of the furnace for supports to be welded to the metallic wall and extended above the refractory and about the tubes for their support.

Of course the more simple form for the hanger, or strap, the less expense in the original installation. However, the need for repair and replacement is always hovering in the background. If a strap crumbles under the furnace conditions, or its tube fails, whatever remains of the strap must be removed and replaced.

Remember, the strap or hanger is simple in form but it extends from the wall of the shell. To get at its connection to the wall, refractory must be removed at its location. If the strap is intact, but the tube has ruptured, the tube must be withdrawn from the strap or the strap must be cut to remove the tube. Strap or tube failure, the prior art practice always includes a messy repair and replacement program.

In design of all furnace parts exposed to the heat generated at the burner, the parts are though of as "consumed." There is a deterioration of materials in the furnace which are exposed to temperature ranges including 1400° F. and the products of combustion. This progressive wasting away is understandably termed consumption. This factor is of prime importance to the engineer of furnace parts.

In the tube support there are certain parts which are unavoidably exposed to the full force of the furnace conditions. The problem is to provide a support whose more consumable part, or parts, can be readily replaced and to keep their exposed surface to a mimimum.

SUMMARY OF THE INVENTION

It is an object of the present invention to provide a multiple-part structural support for furnace tubes with the most vulnerable part arranged to be most easily serviced, repaired or replaced.

Another object is to keep the surface area exposed to furnace conditions to a minimum.

The invention contemplates a furnace support of essentially two parts. The base part is attached directly to the furnace wall and largely insulated from the furnace conditions by refractory. The surfaces exposed directly to the radiant heat of the burner combustion are reduced to a minimum. A strap portion is attached to the base to capture a tube on the base and is arranged for ready disengagement from the base for service, repair or replacement.

Other objects, advantages and features of the invention will become apparent to one skilled in the art upon consideration of the written specification, appended claims, and attached drawing, wherein;

FIG. 1 is a sectional perspective elevation of a portion of a furnace space with hangers arranged to support tubes in place and embodying the present invention; and FIG. 2 is a perspective elevation of a hanger of FIG. 1 with the parts exploded from their installed engagement.

DESCRIPTION OF THE PREFERRED EMBODIMENT

Figure 1:
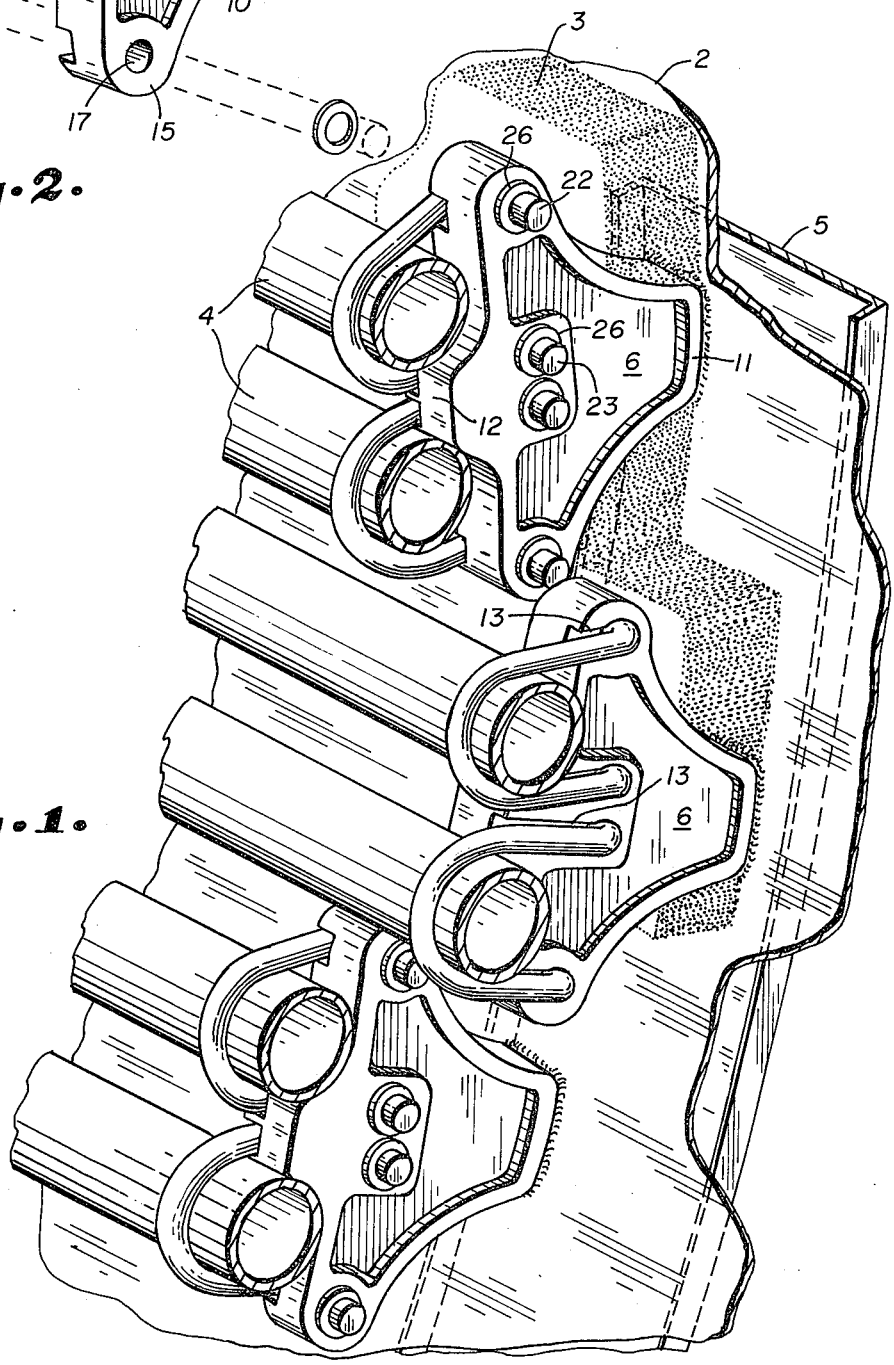

FIG. 1 shows just enough of the furnace structure associated with the invention to orient one skilled in this art. The furnace space is, in simplistic form, a horizontally extended cylinder. FIG. 1 provides a view into that space for inspection of the furnace interior where the tubes are suspended in their operative position.

In FIG. 1, only a fragment of the shell 2 of the furnace wall is shown. As is customary, refractory 3 is cast on the interior of this shell. Pipes, or tubes, 4 are mounted at the refractory surface. This relatively thin metallic shell is reinforced by stout, circular hoops 5 on its outside.

One hoop 5 is partially disclosed. It is disclosed as a channel in cross-section. However, the specific form of this hoop 5 is of little importance to the invention. What is important is the reinforcing this member provides, from exterior of shell 2, for the support structure for the tubes 4.

Hangers 6 are attached to the internal wall of shell 2 at the reinforcing positions provided by the hoops. How many hoops there are, how they are spaced along the length of shell 2, and how they are specifically attached to the shell wall are all somewhat incidental facts, relative to the invention. The broad point to be made is that hangers 6 are mounted on the internal side of shell 2 while hoop 5 is mounted on the external side. So mounted, hangers 6 are shown as horizontally aligned to support tubes 4 at the surface of refractory 3 to substantially cover the interior wall of this furnace. So placed, the tubes absorb the heat generated in the furnace space to raise the temperature of fluid passed through the tubes.

Hangers 6 displace the simple straps of the prior art. Heretofore, up to the present, very simple horseshoe configurations, of hopefully durable metal, have been welded to the interior wall of the furnace shell. The tubes, extending between the legs of these horseshoe-shaped straps, have been held in place with mechanical stability. However, if the refractory must be replaced, the tube must be taken from the wall. If the tube is ruptured, the failed section must be dismounted from the wall. If the strap fails, it must be replaced. In all these cases, the removal of these defective structures is a massive job which consumes much time and requires a tremendous amount of expensive labor and material. The present invention in the new hanger enables these costs to be greatly reduced.

Figure 2:
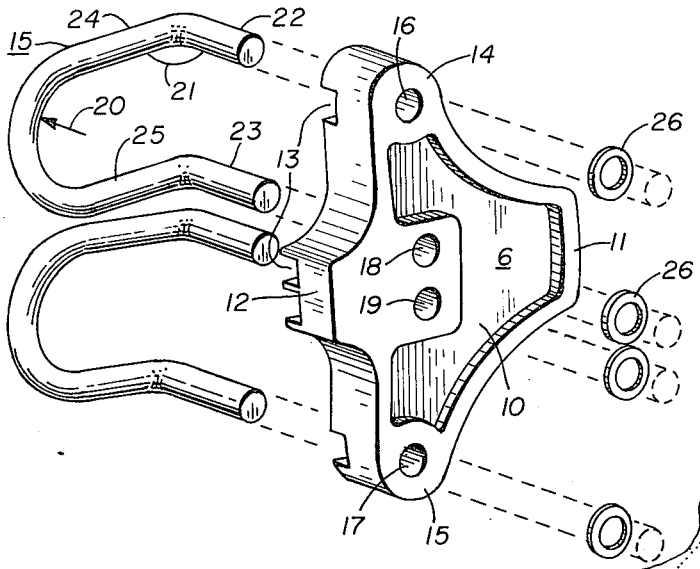

FIG. 2 can now be taken, with FIG. 1, for more complete disclosure of the invention. The complete hanger, or support structure, has been designated 6. The attachment to the shell 2 has only been generally stipulated. In FIG. 1 the evidence is that it is welded. It could also be bolted.

Base 10 has a foot portion 11. There is an engineering problem in balancing the area of foot 11 which will give sufficient stability to base 10 in view of the mechanical stress placed upon the base against the goal of transmitting heat from the base to lower its consumption rate. The temperature of the shell 2 is in the order of 200° F. The temperature of the top surface 12 is in the order of 1400° F. Obviously it is desirable to keep as steep a temperature gradient as possible between the top 12 and foot 11. The average temperature of the base will then be kept low and the consumption rate will be low also.

Top surface 12 is that part of base 10 exposed directly to the radiant heat of the furnace combustion. Tubes 4 shield the remaining surface of the base 10 facing the interior of the furance. This surface is brought toward the radiant heat source far enough to give a substantial portion of the body of base 10 enough mass to withstand the consumption for a satisfactory life span for base 10.

Also, grooves 13 are formed in both the portion of base 10 below surface 12 and ears 14 and 15 of base 10 to give lateral support to the strap 15 when it is placed in operative position on base 10.

The body of base 10 is flared up from foot 11 to provide the mass of ears 14 and 15. Holes 18 and 19 are formed through base body 10 in alignment with holes 16 and 17. These holes are then to be considered in pairs, each pair to receive a strap as the strap extends about a tube 4.

Each strap is then engaged with a pair of holes in a base body. Therefore, there are two straps to each base 10. This arrangement is apparent from FIG. 1.

Although the invention is not limited to the rod-like form for strap 15, this appears to be the preferred embodiment. Each cylindrical rod is bent to the outside radius 20 of the tube 4 it will support. Then the ends of the strap-rod are each bent at a right angle 21 to the plane of the first bending. There may be more precise ways to describe the bending to achieve the configuration disclosed for strap 15, but the result is clear in FIG. 2. Further, in FIG. 1, it is clear that the ends 22 and 23 end up, after the bending, extending parallel to the internal surface of shell 2. So directed, ends 22, 23 of strap 15 readily enter holes 16, 18 of base 10 and secure a tube 4 to the top of base 10. The sides 24, 25 of strap 15 are drawn into grooves 13 of base 10 and are thereby provided transverse support against mechnical forces placed on strap 15 by its capture of tube 4. Finally, washers 26 are placed over the ends 22, 23 as the ends protrude through the holes of base 10. These washers are welded to the strap 15. This arrangement captures a tube 4 securely on base 10. The tube is thereby "hung" on the internal wall of shell 2.

Strap 15 is readily disconnected from base 10 with the proper tools. The weld between strap 15 and washers 26 may be readily broken and washers 26 removed. Strap 15 may then be easily removed from holes 16, 18.

Obviously a large part of strap 15 is directly exposed to the heat of the furnace. It is therefore likely to be "consumed" well before the base 10. However, it is a relatively inexpensive part of the hanger which can be readily replaced. Obviously this replacement can be brought about without the major surgery of refractory removal and disengagement of base 10 from shell 2.

It would, of course, reduce consumption of strap 15 if strap 15 were cooled. However, the heat flow path away strap 15 is broken, to a large extent, by the connection provided between strap 15 and base 10. Of course the heat flow path between strap 15 and the tube 4 it captures could be improved. However, this invention opts for the embodiment in which the strap is easily replaced if consumption has caused its failure. This ready replacement provision, together with the provision of lateral support with the sides of grooves 13, and the provision of a relatively small area of base 10 exposure to the consuming furnace environment are some of the features of the invention which provide significant improvement over the prior art.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an ilustrative and not in a limiting sense.

The invention, having been described, what is claimed is:

1. A support structure for furnace tubes in a furnace space, including, a base member attached to the interior wall of the furnace space and extending its mass normal to the wall surface, a pair of holes extended through the base member in a direction parallel the surface of the wall, grooves in the body of the base and extending from each of the pair of holes normal the surface of the wall, and a strap member arranged with its ends engaged in the holes and extending along the grooves in the body of the base to provide lateral support to the strap member and about a furnace tube to capture the tube on the base and substantially shield the surface of the base from the heat of radiation of the combustion of the furnace.

2. The support structure of claim 1 in which, the strap member is in the form of a rod bent at its middle to the outside radius of the tube supported and bent at each end to enter the holes of the base.

3. The support structure of claim 2 in which, members are attached over and to the ends of the strap member to capture the strap in position on the base and in the base holes and about the tube supported.

4. The support structure of claim 1 in which, the base has a foot portion directly engaged with the attached to the interior wall surface of the furnace space, and the mass of the base flares from the foot portion to provide ear portions, each of which ear portion is penetrated by a hole for the strap member and a relatively small surface is provided at the extreme upper and central portion of the base with unshielded exposure to the radiation heat of the furnace combustion.

* * * * *